US009284753B1

(12) United States Patent
Catlin

(10) Patent No.: US 9,284,753 B1
(45) Date of Patent: Mar. 15, 2016

(54) LOCK PROTECTOR

(71) Applicant: Garry L. Catlin, Miami, FL (US)

(72) Inventor: Garry L. Catlin, Miami, FL (US)

( * ) Notice: Subject to any disclaimer, the term of this patent is extended or adjusted under 35 U.S.C. 154(b) by 0 days.

(21) Appl. No.: 14/821,106

(22) Filed: Aug. 7, 2015

(51) Int. Cl.
*E05B 67/38* (2006.01)

(52) U.S. Cl.
CPC ..... *E05B 67/38* (2013.01); *Y10T 70/493* (2015.04); *Y10T 70/496* (2015.04); *Y10T 70/498* (2015.04)

(58) Field of Classification Search
CPC . E05B 67/38; E05B 67/383; E05B 2067/386; Y10T 70/493; Y10T 70/496; Y10T 70/498; Y10T 70/5739; Y10T 70/5779
USPC ..... 70/DIG. 43, DIG. 56, 417, 54–56, 202, 70/203, 211, 212; 292/148, 205, 218, 281, 292/DIG. 32
See application file for complete search history.

(56) References Cited

U.S. PATENT DOCUMENTS 4,760,720 A * 8/1988 Grille ..... E05B 67/38 70/417
5,477,710 A * 12/1995 Stefanutti ..... E05B 67/38 70/417
5,975,595 A * 11/1999 Lorenzo ..... E05B 67/38 292/205
6,357,266 B1 * 3/2002 Van Buren ..... E05B 83/10 70/211
6,519,982 B1 * 2/2003 Brammall ..... E05B 67/38 292/205
6,581,419 B1 * 6/2003 Strodtman ..... E05B 13/002 292/205
6,622,533 B1 * 9/2003 Santini ..... E05B 13/002 292/282
6,928,843 B1 * 8/2005 Pirnie ..... E05B 67/38 292/205
7,201,028 B1 * 4/2007 Gogel ..... E05B 67/38 292/205
7,412,856 B1 * 8/2008 Gogel ..... E05B 13/002 292/218
7,562,546 B2 * 7/2009 Taylor ..... E05B 67/36 248/551
2004/0221626 A1 * 11/2004 Palzkill ..... E05B 13/002 70/34
2005/0247084 A1 * 11/2005 Rosenberg ..... E05B 67/383 70/32
2005/0252257 A1 * 11/2005 Woods ..... E05B 67/04 70/33
2006/0201211 A1 * 9/2006 Gogel ..... E05B 67/38 70/56
2010/0122559 A1 * 5/2010 Chudzicki ..... E05B 13/002 70/56
2012/0180535 A1 * 7/2012 Dorste ..... E05B 67/38 70/56

* cited by examiner

*Primary Examiner* — Lloyd Gall
(74) *Attorney, Agent, or Firm* — Christopher J. Vandam, PA; Chris Vandam

(57) ABSTRACT

A method of protecting a lock on the latch of a shipping container or trailer door without modifying the door latch includes a ring having a bar that is connected at both ends to the inside of the ring. The bar has an aperture dimensioned similarly to the bore on the retainer and handle elements of the door latch. The ring has a rim on one side including a saddle at each end of the bar so that when the rim is placed over the latch the saddles straddle the handle and the bores on the bar, the handle and the retainer are aligned. A shackle of a lock is placed through the bores on the handle, bar and retainer. The ring prevents cutting tools from directly accessing the shackle thereby protecting the lock.

2 Claims, 3 Drawing Sheets

LOCK PROTECTOR

BACKGROUND OF THE INVENTION

1. Field of the Invention

The present invention relates to security of trailers and shipping containers, and more particularly, to a way to protect a common lock from tampering when attached to the latch mechanism found on common shipping containers and trailers.

2. Description of the Related Art

Several designs for lock protectors have been designed in the past. None of them, however, includes a way to protect the shackle of a lock without any needed modifications to the existing door or latch hardware on common shipping containers and trailers.

Other patents describing related subject matter provide for a number of more or less complicated features that fail to solve the problem in an efficient and economical way. None of these patents suggest the novel features of the present invention.

SUMMARY OF THE INVENTION

It is one of the main objects of the present invention to provide a low cost and simple device to protect the shackle of a lock used to lock common shipping containers and trailers.

It is another object of this invention to provide a lock protector that is easy to install and visually verify that the lock protector is in place and properly performing.

It is still another object of the present invention to provide a lock protector that acts as a theft attempt deterrent by making the robust nature of the device apparent to a prospective thief.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
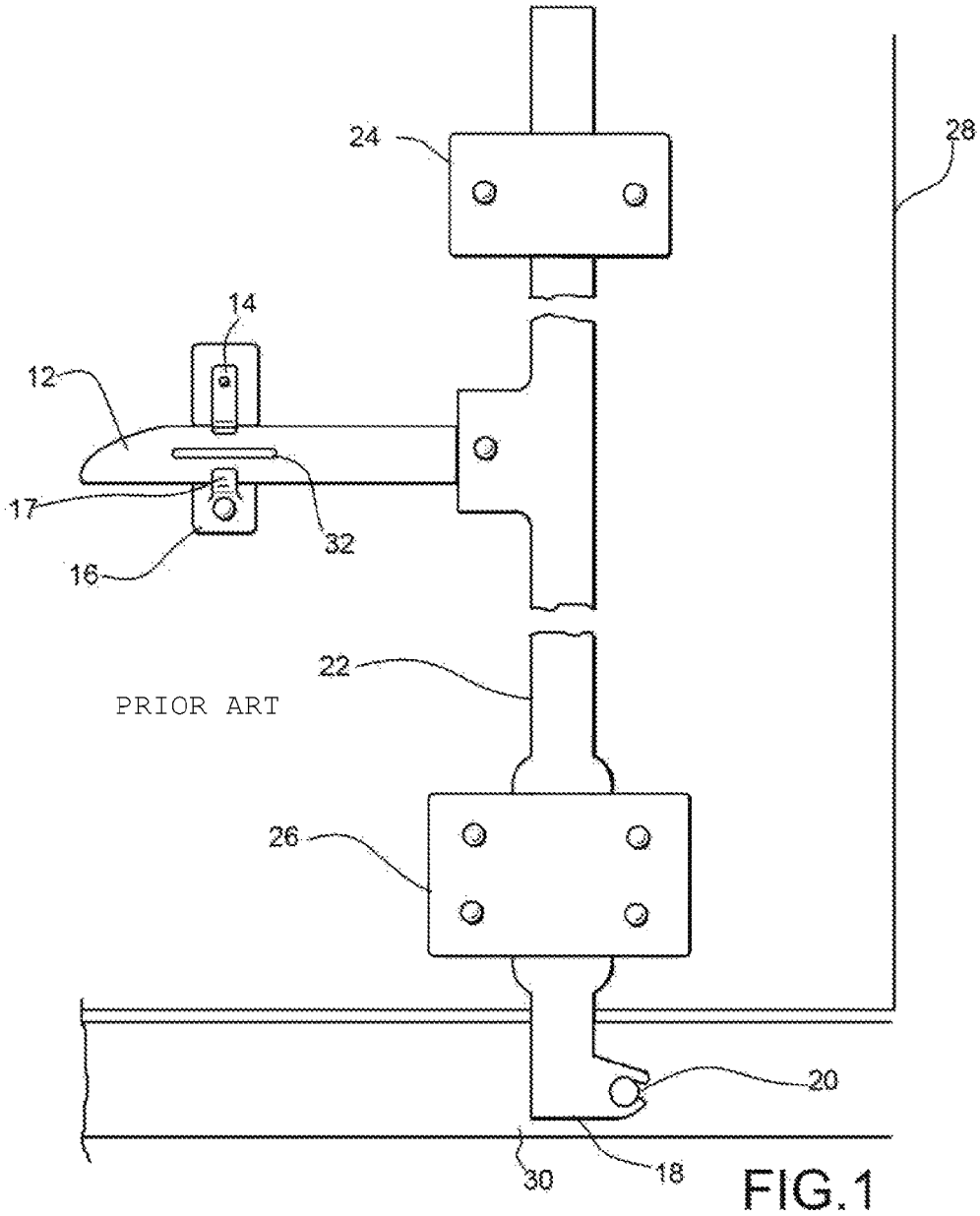
FIG. 1 shows an elevation view of a portion of a shipping container or trailer demonstrating the prior art latch mechanism.
Figure 2:
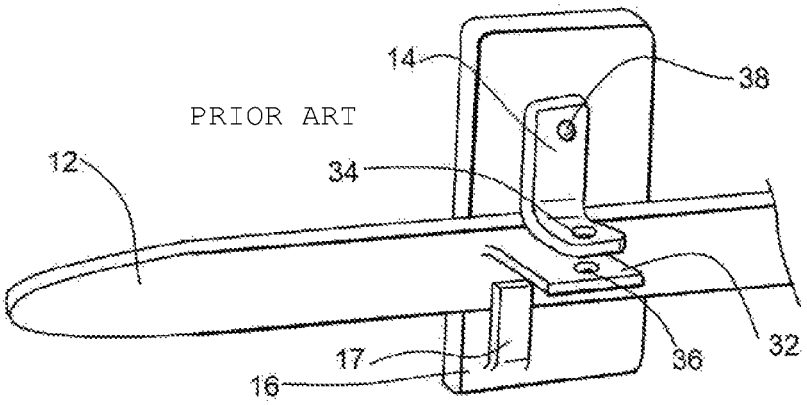
FIG. 2 shows a perspective view close up of part of the prior art latch system on a shipping container or trailer.

The present device and method of protecting a lock applies to the type of locks shown in FIGS. 1 and 2 that are commonly found on Conex-style shipping containers and towed trailers. The lock protector may also work with other types of locks but is particularly suited to shipping containers and trailers. The terms shipping container and trailer as it refers to pre-existing hardware is intended to be used interchangeably.

Referring now to the drawings, where an example of a shipping container or trailer latch system onto which a lock protector is applied is shown in FIGS. 1 and 2. It can be observed that it basically includes a handle 12, a retainer 14, a catch plate 16, a hook 17, a cam 18, a keeper 20, a rod 22, a bracket 26, a door 28, a frame 30, a plate 32, a bore 34, a bore 36 and a hinge 38.

FIGS. 1 and 2 show a common style of shipping container latch system. There are other styles that somewhat differ from that shown that are equally effective when used with a version of the present lock protector. This type of existing latch is provided for enablement and as a common example of the prior art.

Typically the bracket 24 and the bracket 26 are permanently riveted or otherwise secured to an exterior surface of a shipping container door 28. The rod 22 is held by the bracket 24 and bracket 26 while being permitted to rotate axially within bracket 24 and bracket 26 when force is applied to the handle 12.

The plate 32 is typically formed unitary with the handle 12. The plate 32 includes a bore 36 dimensioned to accept a shackle of a typical padlock. The catch plate 16 is typically permanently affixed to the exterior surface of the door 28. The retainer 14 is pinned to the catch plate 16 by a hinge 38 that allows the retainer 14 to move relative to the door 28 while the catch plate 16 remains firmly attached to the door 28. The hook 17 is immobile relative to the catch plate 16 and is thereby also permanently affixed to the door 28.

When the handle 12 rotates the rod 22 the cam 18 is rotated onto or off of the keeper 20. When the handle 12 is positioned against the catch plate 16 the cam 18 is wedged tightly into the keeper 20 and the door 28 is held in a closed position. When the handle 12 is rotated to be perpendicular to the surface of the door 28 then the cam 18 is freed from the keeper 20 and the door is unlocked and is permitted to open.

While transitioning the handle 12 into the locked position, the retainer 14 is rotated about the hinge 38 so that the handle 12 can be placed over the hook 17 and against the catch plate 16. The retainer 14 is then rotated in the down position against the plate 32 on the handle 12. The bore 34 on the retainer 14 lines up with the bore 36 on the plate 32 and the handle 12 is held into the hook 17.

In the prior art, a user of the trailer would close the door 28 and tightly close the door by rotating the cam 18 into the keeper 20 with the handle 12 in the hook 17 and against the catch plate 16. A padlock (not shown in the drawings would then be placed through the bore 34 on the retainer 14 and through the bore 36 on the plate 32 that is part of the handle 12. The handle 12 is thereby fixed relative to the catch plate 16 and the rod 22 cannot be rotated and therefore the cam 18 remains wedged into the keeper 20 and the door 28 remains locked.

Figure 3:
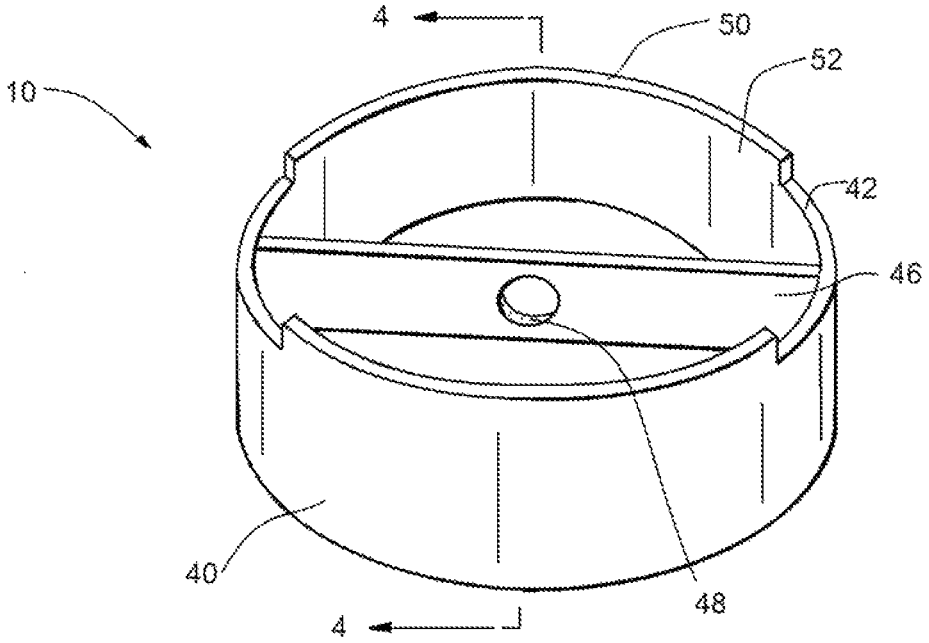
FIG. 3 shows a perspective view of a version of a lock protector.
Figure 4:
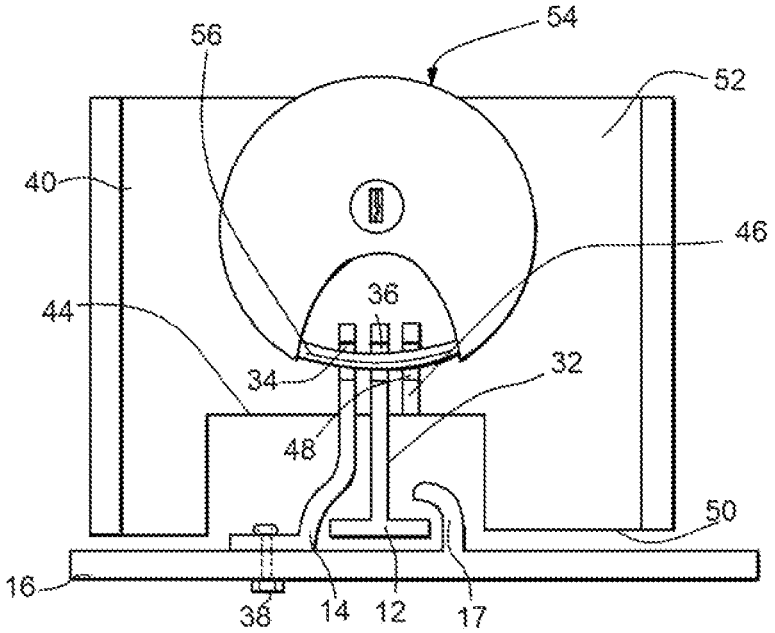
FIG. 4 shows an elevation cross section view of a lock protector as it might be in actual use with a padlock.

Now referring to FIGS. 3 and 4 where a version of a lock protector is shown and identified generally by numeral 10. This version of a lock protector includes, among other features, a ring 40, a saddle 42, a saddle 44, a bar 46, a bore 48, a rim 50, a surface 52, a lock assembly 54 and a shackle 56.

Looking at FIG. 3, a version of a lock protector is shown isolated from the elements of the lock assembly as shown in FIGS. 1 and 2. FIG. 4 shows an example of how the lock protector in FIG. 3 might be in use on a door lock similar to that shown in FIGS. 1 and 2. FIG. 4 is a cross section along the call out 4, shown in FIG. 3.

The primary structure is the ring 40. The ring 40 is generally cylindrical. The ring 40 is generally made of steel or other highly cut-resistant and durable material. The ring 40 is the barrier keeping unwanted cutting tools away from the shackle 56 of the lock assembly 54. The diameter of the ring 40 is generally sufficient to encircle the bore 34 on the retainer 14, the bore 36 on the plate 32 and the lock assembly 54. It has been found to be effective for the diameter of the ring to be from about 2 to about 5 inches in diameter. The diameter of the ring 40 should not be large enough to allow a thief's cutting tool to access the shackle 56.

The bar 46 spans the interior of the ring 40, touching the surface 52 of the ring 40 at both ends of the bar 46. The bar 46 is affixed by welds or other attachment means to the interior surface 52 of the ring 40 so that the ring 40 and bar 46 are inseparable. An efficient means of construction of a lock protector has the ring 40 and bar 46 made of the same or similar material to allow for a functional and strong weld joint between these elements.

The bar 46 spans approximately across a diameter of the ring 40. It can in some versions be somewhat offset from the true diameter so that the bar 46 can better align with the plate 32 and retainer 14. The bar 46 includes an aperture 48 dimensioned to fit the shackle 56 of a predetermined lock assembly 54.

At either end of the bar 46 the rim 50 is interrupted by a saddle 42 and saddle 44. In use the rim 50 is placed against the catch plate 16 on the door 28. The saddle 42 and saddle 44 span over the handle 12 to allow the lock protector to more fully cover the plate 32 and retainer 14. By nature of the saddles 42 and 44 straddling the handle 12 the lock protector as whole will tend to vibrate and rattle less during movement on a trailer or shipping container.

FIG. 4 is a cross section of how a lock assembly 54 might be engaged with the lock hardware on the door. The shackle 56 of the lock assembly 54 passes through the bore 34 on the retainer 14 and the bore 36 on the handle 12 and the bore 48 on the bar 46 thereby keeping the ring 40 around the shackle 56 and preventing cutting tools from having clear access to the shackle 56 and thus keeping the lock assembly 54 intact and securing the trailer doors 28 or shipping container doors in a safely closed and locked position.

Figure 5:
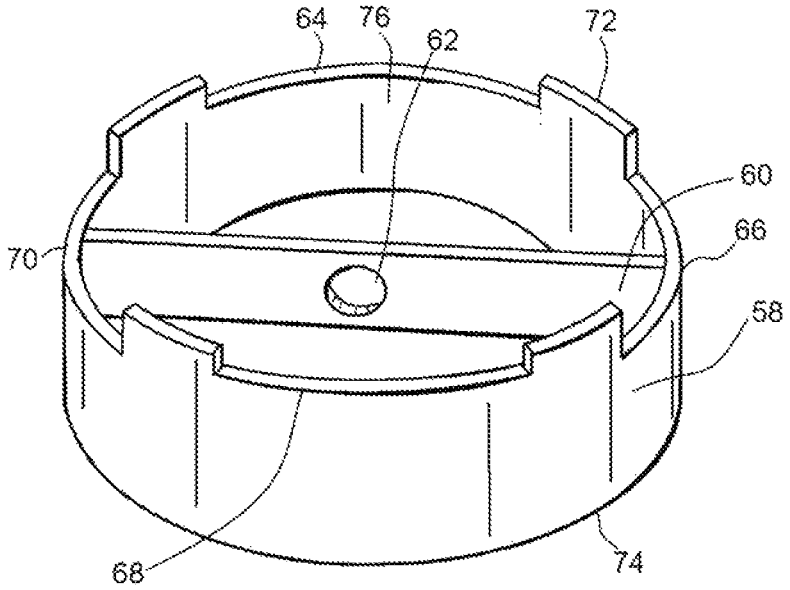
FIG. 5 shows a perspective view of a version of a lock protector.
Figure 6:
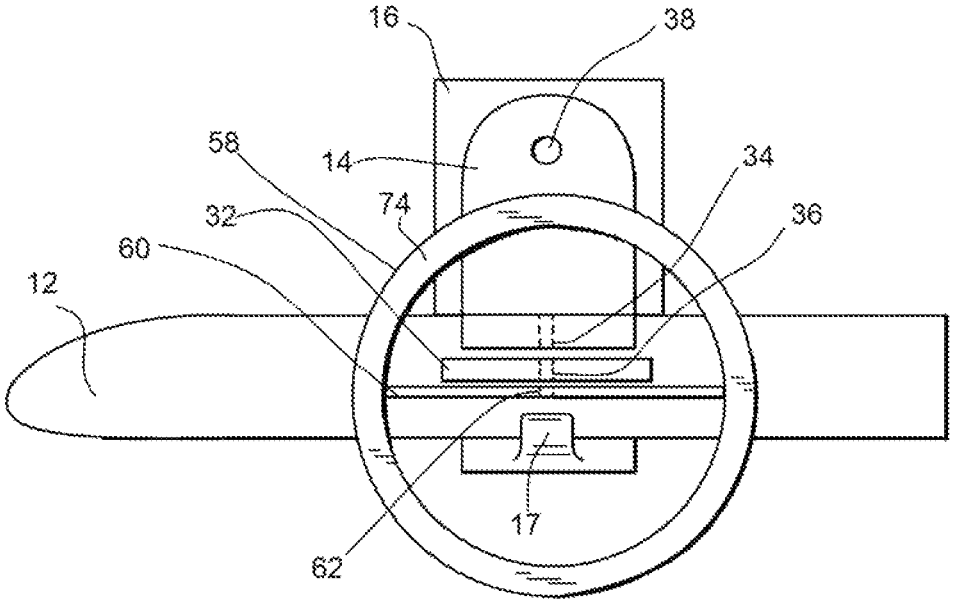
FIG. 6 shows an elevation view of a lock protector installed onto a shipping container or trailer door without a padlock installed.

FIGS. 5 and 6 show a variation of a lock protector that includes, among other features, a ring 58, a bar 60, a bore 62, a saddle 64, a saddle 66, saddle 68, a saddle 70, a rim 72, a rim 74 and a surface 76. The lock assembly shown in FIGS. 5 and 6 are applied to a trailer or shipping container door similar to that shown in FIGS. 1 and 2 and described in other versions of the invention, above.

A noticeable difference between this version and those shown above is the inclusion of saddles 64, 66, 68 and 70, each at about a ninety degree interval from the adjacent saddle interrupting the rim 72 on the edge of the ring 58.

As demonstrated in FIG. 6 the saddle 66 and saddle 70 span over the handle 12 so that the rim 72 can be placed against the door. The saddle 64 and saddle 68 span the width of the catch plate 16, also allowing the rim 72 to contact the door. It is preferred that the rim 72 be in close contact to the underlying door to reduce rattling during movement of the trailer or container. It also allows the bar 60 and bore 62 to get closer to the retainer 14 and its bore 34 and the plate 32 with its bore 36.

FIG. 6 shows this version of a lock protector without a lock installed as it might be configured immediately prior to inserting a padlock through the bores 62, 34 and 36 simultaneously to lock the container or trailer securely.

To use a lock protector a conventional door on a shipping container or trailer is closed and the handle 12 is rotated to lock the cam 18 into the keeper 20. The handle 12 is held against the catch plate 16 by the retainer 14. The bore 34 in the retainer 14 lines up concentrically with the bore 36 in the plate 32. The lock protector is placed over and around the retainer 14 and the plate 32 so that the bore 62 in the bar 60 lines up concentrically with the bores 34 and 36. The shackle of a padlock is placed through the bores 34, 36 and 62 thereby preventing the unlatching of the door. The ring 58 surrounds the shackle of the padlock effectively preventing a thief's cutting tool from attacking the shackle.

The present invention can be characterized and described both as an apparatus to protect a lock and a method of protecting a lock.

The invention in its several variations can be fairly described as a method of protecting a lock on a latch of a shipping container door or trailer door. The latch on the shipping container door or trailer door is not modified to be used with this method or device. It is used with standard locks on these types of doors. The door is closed and sealed by rotating a latch handle against a catch plate so that a first bore on and completely through the latch handle concentrically aligns with a second bore on and completely through a retainer. A ring is provided that has a bar spanning across a diameter of the ring. The bar is permanently affixed to an interior surface of the ring at each end of the bar, typically by welding it to the interior of the ring at both ends. The bar has a third bore passing completely through the bar. The ring has a first rim and a second rim, each on opposite ends of the ring. The ring on the first rim has a first saddle adjacent to a first end of the bar and a second saddle adjacent to a second end of the bar. The first rim is placed over the handle so that the first saddle and the second saddle straddle the handle to get closer to the door and the first bore and second bore and third bore are concentrically aligned. A shackle of a preselected padlock is secured through the first bore and the second bore and the third bore. The distance between the third bore and the second rim is greater than a height of the shackle so that the shackle of the padlock cannot be directly accessed by a thief's cutting tool.

A variation of this method includes that the first rim also includes a third saddle between the first saddle and second saddle and a fourth saddle on the first rim opposite the third saddle. The third and fourth saddle effectively straddle the catch plate.

The term padlock is intended to include any variety of portable locking devices that can be selectively opened and closed. Some are openable with keys, combinations, passwords, biometric sensors, electronic signals. For example, some manufacturers refer to versions of such types of locking devices as dishlocks, disc padlocks, shrouded discs or locker locks. Some locks will have straight or curved shackles of varying diameters that are preferably similarly sized or slightly smaller than the several bores in the present lock protector.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A method of protecting a lock on a latch of a shipping container door or trailer door comprising:

Rotating a latch handle against a catch plate so that a first bore on the latch handle concentrically aligns with a second bore on a retainer;

A ring is provided that has a bar spanning across a diameter of the ring;

The bar is permanently affixed to an interior surface of the ring at each end of the bar;

The bar has a third bore;

The ring has a first rim and a second rim;

The first rim on the ring has a first saddle adjacent to a first end of the bar and a second saddle adjacent to a second end of the bar;

The first rim is placed over the handle so that the first saddle and the second saddle straddle the handle and the first bore and second bore and third bore are concentrically aligned;

A shackle of a preselected padlock is secured through the first bore and the second bore and the third bore;

The distance between the third bore and the second rim is greater than a height of the shackle so that the shackle of the padlock cannot be directly accessed by a cutting tool.

2. The method of protecting a lock on a latch of a shipping container door or trailer door as in claim 1 further characterized in that the first rim also includes a third saddle between the first saddle and second saddle and a fourth saddle on the first rim opposite the third saddle.

* * * * *